US008297063B2

(12) United States Patent
Junge et al.

(10) Patent No.: US 8,297,063 B2
(45) Date of Patent: Oct. 30, 2012

(54) METHOD FOR SERVICING A REFRIGERATION SYSTEM

(75) Inventors: Brent Alden Junge, Evansville, IN (US); Michael Thomas Groh, Louisville, KY (US); Jeffrey Jacoby, Goshen, KY (US); Lee Mathieson, Georgetown, IN (US); Richard Miller, Louisville, KY (US); Alan J. Mitchell, Louisville, KY (US); Michael Christopher Ross, Louisville, KY (US); Martin Mitchell Zentner, Prospect, KY (US)

(73) Assignee: General Electric Company, Schenectady, NY (US)

( * ) Notice: Subject to any disclaimer, the term of this patent is extended or adjusted under 35 U.S.C. 154(b) by 595 days.

(21) Appl. No.: 12/536,894

(22) Filed: Aug. 6, 2009

(65) Prior Publication Data

US 2010/0037636 A1 Feb. 18, 2010

Related U.S. Application Data

(60) Provisional application No. 61/088,240, filed on Aug. 12, 2008.

(51) Int. Cl.
*F25B 45/00* (2006.01)

(52) U.S. Cl. ..... 62/77; 62/149; 62/292

(58) Field of Classification Search ..... 62/77, 149, 62/272, 148, 476, 490, 292
See application file for complete search history.

(56) References Cited

U.S. PATENT DOCUMENTS

| | | | | |
|---|---|---|---|---|
| 3,976,110 | A | | 8/1976 | White |
| 4,961,244 | A | | 10/1990 | Stanfield et al. |
| 5,122,355 | A | | 6/1992 | Prasad et al. |
| 5,289,690 | A | | 3/1994 | Rockenfeller et al. |
| 5,293,756 | A | | 3/1994 | Nelson et al. |
| 5,388,417 | A | | 2/1995 | Hughes, Jr. et al. |
| 5,392,610 | A | | 2/1995 | Nelson et al. |
| 5,408,840 | A | | 4/1995 | Talley et al. |
| 5,425,242 | A | | 6/1995 | Dunne et al. |
| 5,471,852 | A | | 12/1995 | Meckler |
| 5,511,387 | A | * | 4/1996 | Tinsler ..... 62/292 |
| 5,540,254 | A | * | 7/1996 | McGowan et al. ..... 137/315.01 |
| 5,544,492 | A | | 8/1996 | Manz |
| 5,589,630 | A | | 12/1996 | Wiegand et al. |
| 5,615,695 | A | | 4/1997 | Chambers |

(Continued)

FOREIGN PATENT DOCUMENTS

JP 2005-236050 * 9/2005

(Continued)

OTHER PUBLICATIONS

Abstract of JP 2005236050 to Massaki et al.*

(Continued)

*Primary Examiner* — Mohammad Ali
(74) *Attorney, Agent, or Firm* — Global Patent Operation; Douglas D. Zhang

(57) ABSTRACT

A method for servicing a refrigeration system is disclosed. The refrigeration system contains a refrigerant and has a compressor, a high-side section and a low-side section. The method includes the steps of releasing the refrigerant from the refrigeration system from the high-side section; collecting the released refrigerant with a recovery container containing a refrigerant adsorptive substance; charging the refrigeration system with inert gas from the low-side section; and discharging the inert gas from the refrigeration system from the high-side section.

23 Claims, 8 Drawing Sheets

U.S. PATENT DOCUMENTS

| | | | | |
|---|---|---|---|---|
| 5,699,678 | A * | 12/1997 | Trigiani | 62/292 |
| 5,779,998 | A | 7/1998 | Tom | |
| 6,006,543 | A | 12/1999 | Byrd et al. | |
| 6,141,977 | A | 11/2000 | Zugibe | |
| 6,155,058 | A | 12/2000 | Kanno et al. | |
| 6,199,602 | B1 | 3/2001 | Maginot et al. | |
| 6,216,473 | B1 * | 4/2001 | Arii | 62/77 |
| 6,247,325 | B1 * | 6/2001 | Muston et al. | 62/292 |
| 6,360,554 | B1 | 3/2002 | Trachtenberg | |
| 6,449,962 | B1 * | 9/2002 | Takemasa et al. | 62/77 |
| 6,592,653 | B2 | 7/2003 | Wang et al. | |
| 6,749,405 | B2 * | 6/2004 | Bassine | 417/313 |
| 7,260,943 | B2 | 8/2007 | Carrubba et al. | |
| 7,293,419 | B1 | 11/2007 | Moller et al. | |
| 2004/0123622 | A1 | 7/2004 | Yuzawa et al. | |
| 2005/0109207 | A1 | 5/2005 | Olander et al. | |
| 2007/0282142 | A1 * | 12/2007 | Ohmi et al. | 570/124 |

FOREIGN PATENT DOCUMENTS

| | | | |
|---|---|---|---|
| WO | 8901119 | B1 | 2/1989 |

OTHER PUBLICATIONS

Transation of JP 2005-236050 to Masaaki et al.*

* cited by examiner

METHOD FOR SERVICING A REFRIGERATION SYSTEM

CROSS-REFERENCE TO RELATED APPLICATIONS

The present application claims priority to U.S. Provisional Patent Application Ser. No. 61/088,240 entitled "METHOD AND APPARATUS FOR RECLAMATION OF REFRIGERANT", filed Aug. 12, 2008, the entire disclosure of which is incorporated herein by reference.

The present application relates to U.S. patent application Ser. No. 12/536,694 entitled METHOD AND APPARATUS FOR COLLECTING REFRIGERANT, filed Aug. 6, 2009, the entire disclosure of which is incorporated herein by reference.

BACKGROUND OF THE INVENTION

The present disclosure relates generally to refrigeration. More particularly, the present disclosure relates to methods for collecting a hydrocarbon refrigerant such as R-600a (i.e., Isobutane) and methods for servicing or repairing a refrigeration system containing such a refrigerant. As used herein, the expression "servicing" or "service" includes repair.

Generally, the refrigeration system of a cooling appliance such as a refrigerator uses a vapor-compression cycle wherein a refrigerant or coolant, such as R-134a, enters a compressor and goes through various processes before traveling through the coils or tubes of an evaporator disposed inside the refrigerator. A fan may be used to circulate air across the coils or tubes of the evaporator so that the refrigerant extracts heat from the air. The cooled air is then used for cooling purposes. In a refrigerator, the cooled air is returned to the freezer compartment and/or the food compartment. The vapor-compression cycle is well known in the art, and therefore will not be discussed in detail here.

During the servicing or repair of the refrigeration system, the refrigerant cannot remain in the refrigeration system because of safety concerns. It should therefore be safely removed from the refrigeration system before servicing or repair. After the servicing or repair, the refrigeration system must be charged with a replacement refrigerant.

Various organizations, such as the Environmental Protection Agency (hereinafter "EPA") and the World Heath Organization (also known as "WHO"), have attributed negative environmental changes, such as the reduction of ozone layer, to the release of refrigerants into the atmosphere. Recent and continuing environmental objectives and directives thus require the use of more environmentally friendly materials as refrigerants. As a result, refrigerants have been changed from chlorofluorocarbons (CFC) and hydro chlorofluorocarbons (HCFC) to hydro fluorocarbons (HFC), and more recently from HFC to Hydrocarbons (HC). The compositions of these refrigerants are well known in the art, and therefore will not be discussed here.

HC refrigerants require different collecting and servicing processes. Pumps have been used to transfer refrigerant, such as CFC or HFC, from a refrigeration system to a recovery container such as a pouch. However, HC is significantly more flammable than HFC. Therefore, using pumps to transfer HC is not practical due to safety/ignition concerns. In many European countries, the common practice in repair is to vent HC directly into the atmosphere outside of a house. However, the EPA does not permit this type of venting in the United States as it has passed specific regulations for the reclamation and disposal of refrigerants.

It is therefore desirable to have methods for collecting an HC refrigerant and for servicing a refrigeration system containing such a refrigerant that comply with the EPA regulations and to provide a safe and efficient service method.

SUMMARY OF THE INVENTION

As described herein, the embodiments of the present invention overcome one or more of the above or other disadvantages known in the art.

One aspect of the present invention relates to a method for collecting a hydrocarbon refrigerant from a refrigeration system. The refrigeration system includes a compressor, a high-side section and a low-side section. The method includes the steps of releasing the hydrocarbon refrigerant from the refrigeration system from the high-side section; and collecting the released hydrocarbon refrigerant with a recovery container containing a hydrocarbon refrigerant adsorptive substance.

Another aspect of the present invention relates to a method for servicing a refrigeration system. The refrigeration system contains a refrigerant and has a compressor, a high-side section and a low-side section. The method includes the steps of releasing the refrigerant from the refrigeration system from the high-side section; collecting the released refrigerant with a recovery container containing a refrigerant adsorptive substance; charging the refrigeration system with inert gas from the low-side section; and discharging the inert gas from the refrigeration system from the high-side section.

These and other aspects and advantages of the preferred embodiments of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE EXEMPLARY EMBODIMENTS OF THE INVENTION

Figure 1:
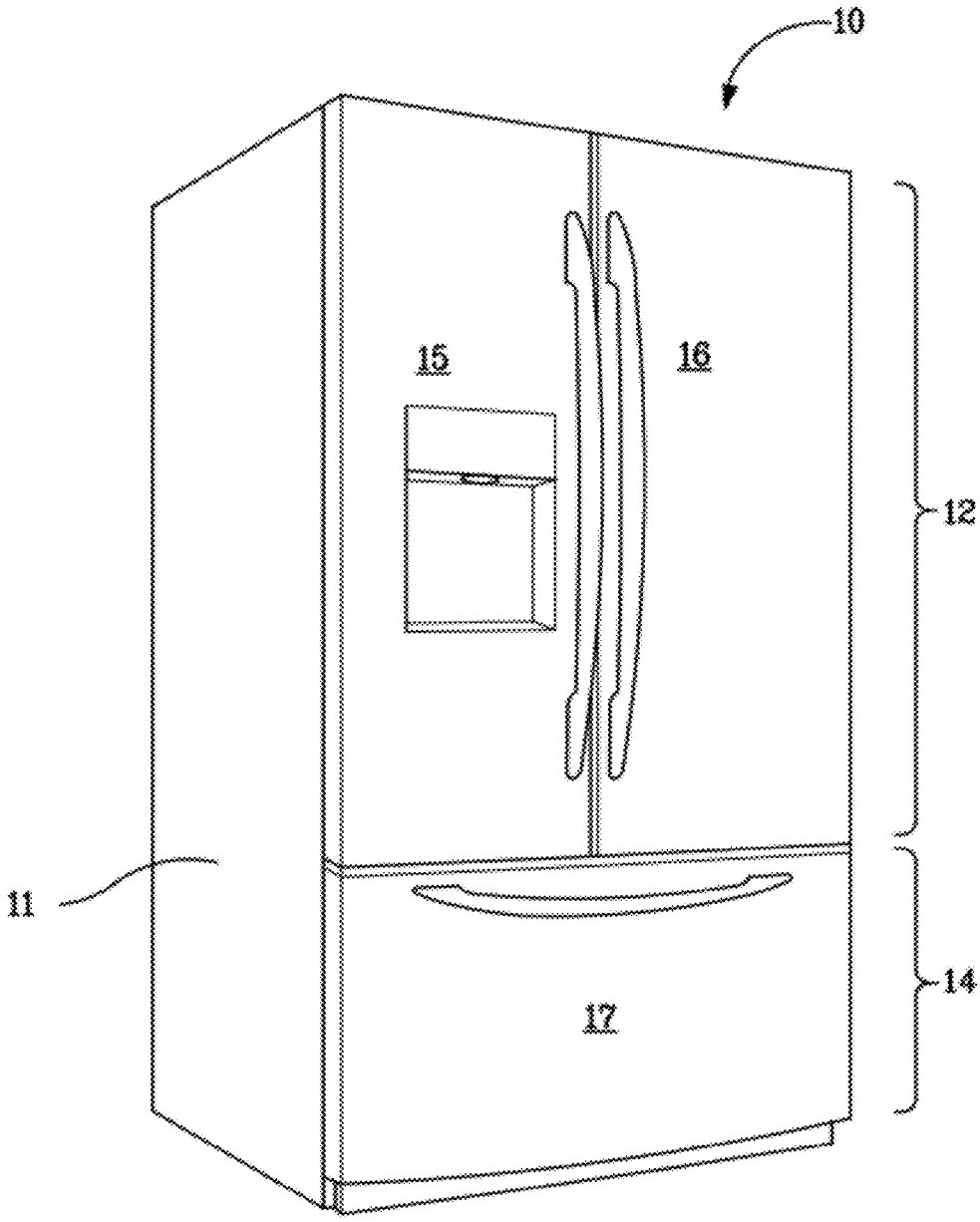
FIG. 1 is a perspective view of an exemplary refrigerator employing an exemplary refrigeration system.
Figure 2:
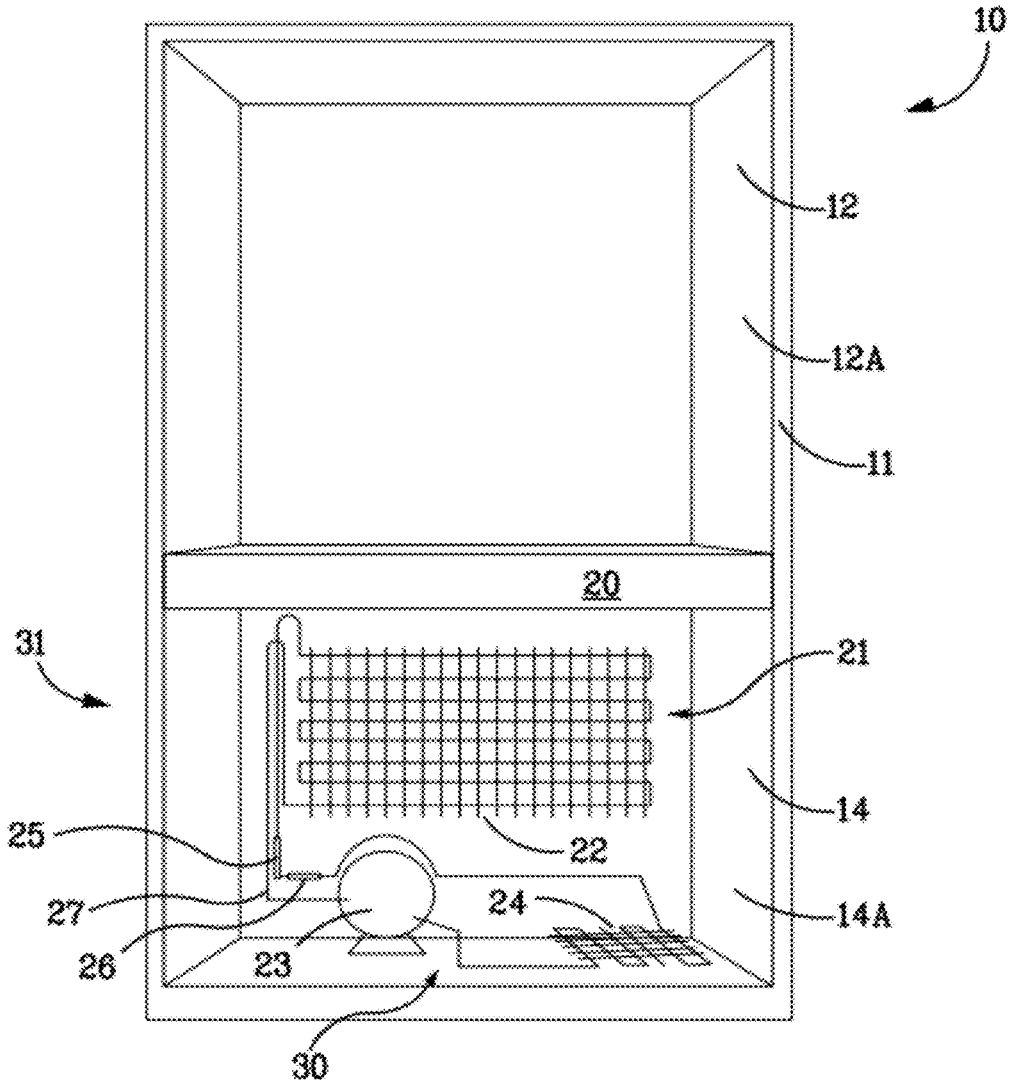
FIG. 2 is a perspective view of the refrigerator of FIG. 1, with the doors for the fresh food compartment and the freezer compartment being removed and with the refrigeration system being schematically illustrated.

Referring now to FIGS. 1 and 2, an exemplary refrigerator employing an exemplary refrigeration system is generally designated by reference numeral 10. The refrigerator 10 has a main body 11 which defines therein a first, upper, fresh food compartment 12 with a frontal access opening 12A and a second, lower, freezer compartment 14 with a frontal access opening 14A. The fresh food compartment 12 and the freezer compartment 14 are arranged in a bottom mount configuration where the fresh food compartment 12 is disposed or positioned above the freezer compartment 14. A mullion 20 separates the fresh food compartment 12 from the freezer compartment 14.

The fresh food compartment 12 is shown with two French doors 15 and 16, which are rotatably attached to the main body 11 in a known manner. However, a single door can be used instead of the doors 15, 16. The freezer compartment 14 is closed by a drawer or a door 17. When a door is used for the freezer compartment 14, it is rotatably attached to the main body 11 in a known manner. When a drawer is used for the freezer compartment 14, it is slidably received in the interior or cavity defined by the freezer compartment 14 in a known manner. The drawer/door 17 and the doors 15, 16 close the frontal access openings 14A, 12A, respectively.

As clearly shown in FIG. 2, the refrigerator 10 has a sealed refrigeration system 21, which includes an evaporator 22 disposed in the freezer compartment 14, a compressor 23 disposed downstream of the evaporator 22 and outside of the freezer compartment 14 (usually in the mechanical compartment of the refrigerator 10, not shown), a condenser 24 disposed downstream of the compressor 23 and outside of the freezer compartment 14 and exposed to the ambient air surrounding the refrigerator 10, a restriction 25 such as an expansion valve or a capillary tube, disposed downstream of the condenser 24 and upstream of the evaporator 22, a drier 26 disposed between the condenser 24 and the restriction 25, and a fluid connection loop 27 fluidly connecting these elements 22-26 together. The sealed refrigeration system 21 contains a hydrocarbon refrigerant such as R-600a. Cold air, which is cooled by the evaporator 22, may be delivered, through a channel and/or a damper (not shown), to the fresh food compartment 12 to maintain the temperature in the fresh food compartment 12 at a selected level. The sealed refrigeration system 21 is known in the art, and can be used not only for the bottom mount refrigerator 10 shown in FIGS. 1 and 2, but also for other types of refrigerators.

As is known in the art, the sealed refrigeration system 21 comprises a high-side section 30 and a low-side section 31. The high-side section 30 refers to the section of the sealed refrigeration system 21, which extends from the output of the compressor 23 to the condenser 24 and then to the input of the restriction 25 where the pressure is relatively high during operation. The low-side section 31 refers to the section of the refrigeration system 21, which extends from the output of restriction 25 to the evaporator 22 and then to the input of the compressor 23 where the pressure is relatively low compared with the pressure in the high-side section 30 during operation. For any given refrigeration system, its high-side section and low-side section are known to a person skilled in the art.

Exemplary embodiments of the collecting and servicing methods of the present invention are discussed in detail below in connection with the refrigeration system 21 of FIG. 2.

If the sealed refrigeration system 21 needs servicing or repair, an operator (i.e., a service technician) needs to release the refrigerant from the refrigeration system 21 first. It is preferred to release the refrigerant from the refrigeration system 21 from the high-side section 30. To accomplish this, in step 301 (FIG. 3), the technician first penetrates the refrigeration system 21 with a device by, for example, attaching a piercing valve 32 (FIG. 4) to a location on the high-side section 30, and then piercing the chosen location so that the refrigerant can be released through the piercing valve 32. In one embodiment, the technician uses the piercing valve 32 to pierce a process tube 33 at the drier 26.

Figure 3:
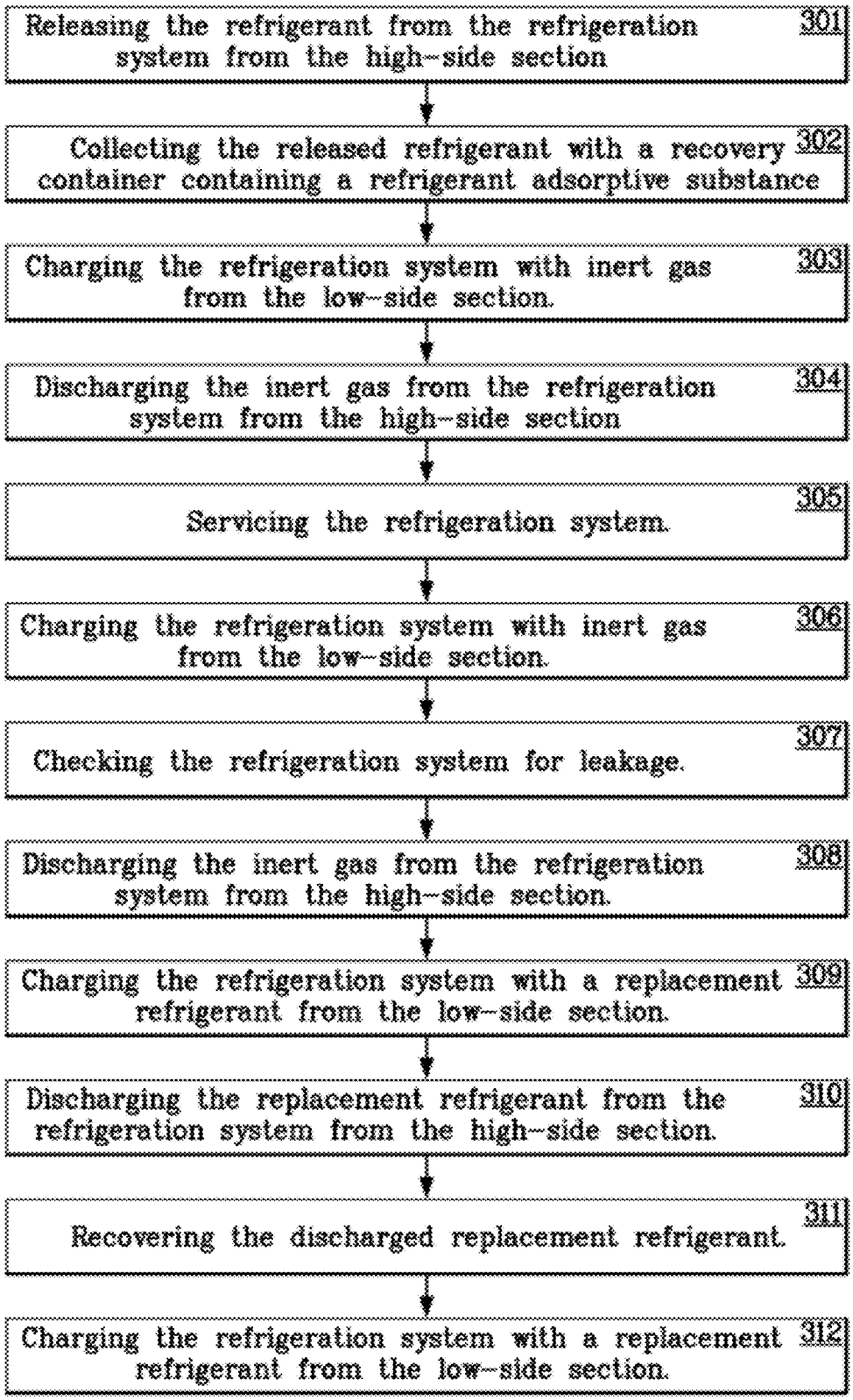
FIG. 3 is a flow chart describing the exemplary embodiments of the collecting and servicing methods in accordance with the present invention.
Figure 4:
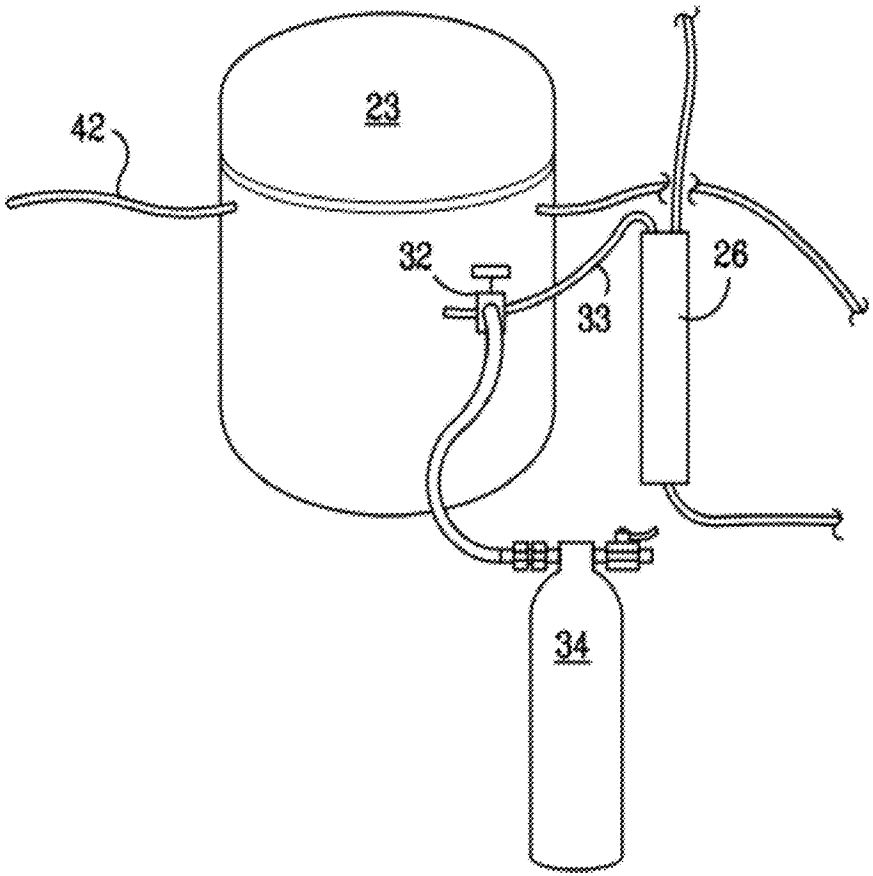
FIGS. 4-8 schematically illustrate some of the steps of the methods of FIG. 3.

Any released refrigerant needs to be collected (step 302 in FIG. 3). To this end, the technician connects the hose of a recovery container 34 (FIG. 4) to the pierce valve 32 in a known manner. In one embodiment, the recovery container 34 contains a substance, such as active carbon, which is adsorptive to the refrigerant such as R-600a. After a substantially sealed connection is made, the technician opens the piercing valve 32, which will allow the refrigerant to flow from the refrigeration system 21 into the recovery container 34 even without the help of the compressor 23 because the pressure in the high-side section 30 is above atmospheric pressure. If the compressor 23 is operable, the technician may run the compressor 23 during the releasing step to facilitate or speed up the release of the refrigerant.

After a substantial amount of the refrigerant has been released from the refrigeration system 21 (when the technician no longer hears the refrigerant flowing out of the refrigeration system 21 or feels anything flowing through the hose, for example) or after a predetermined period of time has lapsed (in one embodiment, it takes about five minutes for the refrigerant inside the refrigeration system 21 to reach the atmospheric pressure), the technician closes the piercing valve 32, disconnects the hose from the piercing valve 32, and moves the recovery container 34 away from the refrigeration system 21. The technician also turns off the compressor 23 if it is used in step 301.

Figure 5:
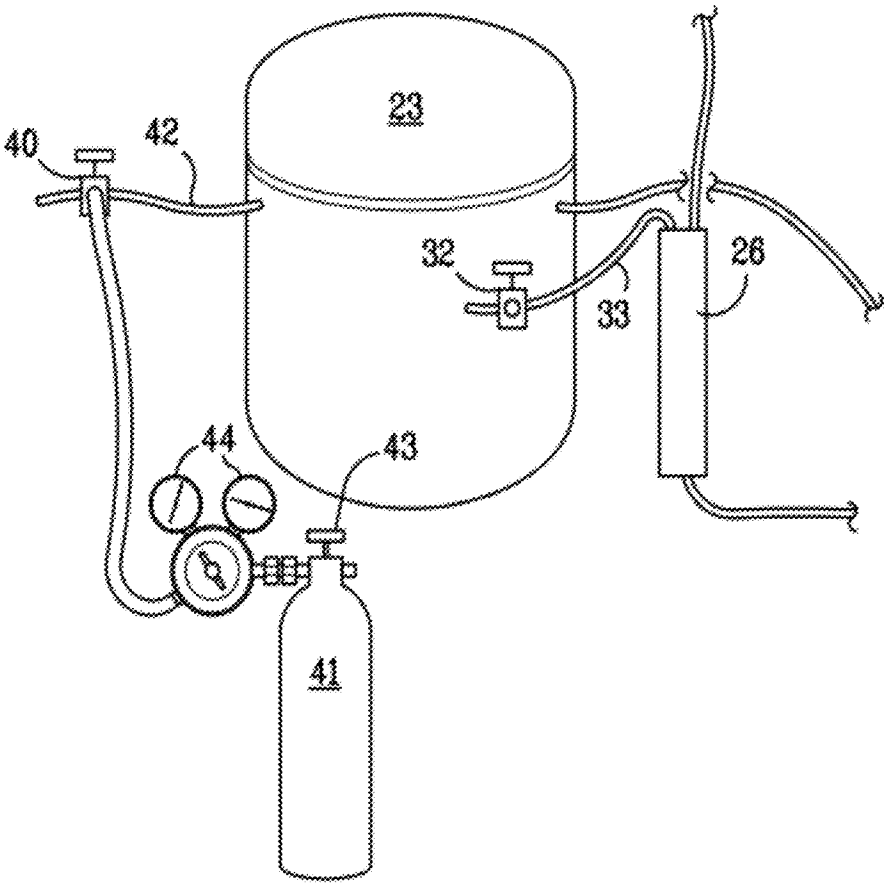

Since some refrigerant and oxygen may remain in the refrigeration system 21, a sweep charge is recommended. To this end, the technician attaches a piercing valve 40 (FIG. 5) to a location on the low-side section 31, pierces the chosen location, and connects the hose of a pressurized inert gas tank 41 to the piercing valve 40. In the embodiment shown in FIG. 5, the chosen location is the process tube 42 at the compressor 23, and the inert gas is nitrogen. Other inert gas that can be used includes helium, argon, and carbon dioxide. Then the technician slowly charges the refrigeration system 21 with inert gas from the low-side section 31 (step 303 in FIG. 3) by slowly opening the piercing valve 40 and the control valve 43 of the insert gas tank 41. The compressor 23 is inactive in this charging step 303. Preferably, the charging step 303 is terminated by closing the control valve 43 of the inert gas tank 41 when the pressure inside the low-side section 31 is about, for example, 50 psig. The inert gas tank 41 is equipped with pressure gauges 44 so that the technician can tell the pressure inside the low-side section 31.

The technician then discharges the inert gas from the refrigeration system 21 from the high-side section 30 into the atmosphere by opening the piercing valve 32. It is preferred that the inert gas be discharged or vented slowly to reduce the amount of oil carried out by the inert gas. Moreover, it is not desirable to suck foreign matter such as moisture into the refrigeration system 21 when the refrigeration system 21 has a leak. Thus, the compressor 23 should remain inactive in the discharging step 304.

The technician then removes both of the piercing valves 32 and 40, and the refrigeration system 21 is ready for repair or service. In step 305, the technician can do any needed repair or service to the refrigeration system 21. The repair or service may include replacing part(s), cutting tube(s), installation of a new drier and a service or process valve, and brazing. Alternatively, the refrigerator 10 may not be repaired or serviced but rather be taken away to a refuse station.

In one embodiment, after the repairing or servicing step 305, the refrigeration system 21 is again charged with inert gas (step 306). In step 307, the technician checks for any leaks at all tubing joints by using a liquid such as liquid soap. The inert gas is then discharged (step 308) from the refrigeration system 21.

Figure 6:
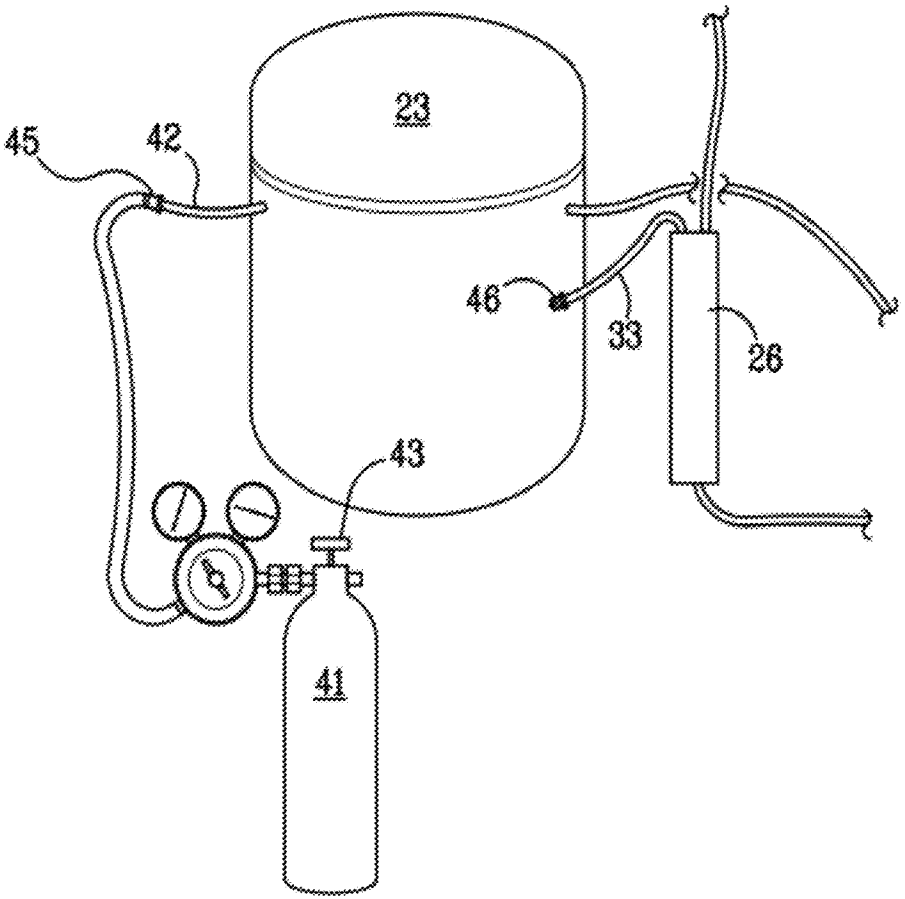

In step 306, inert gas is charged into the refrigeration system 21 from the low-side section 31 through, for example, the low-side access valve 45 (FIG. 6). The same inert gas tank 41 or another pressurized inert gas tank containing the same or different kind of inert gas can be used for this charging step (step 306), which is essentially a repeat of step 303. Step 306 is terminated when the pressure inside the low-side section 31 reaches, for example, approximately 50 psig. The compressor 23 should remain inactive for charging step 306. In discharging step 308, the compressor 23 can be run for at least a minute to facilitate discharge. The inert gas can be freed or discharged from the refrigeration system 21 from the high-side section 30 through, for example, the high-side access valve 46 on the high-side process tube 33.

After the repair or service, the refrigeration system 21 needs to be filled with a replacement refrigerant, which in most cases is of the same type as the original refrigerant in the refrigeration system 21. For example, if the original refrigerant is R-600a. Then in most cases, the replacement refrigerant will be R-600a.

Figure 7:
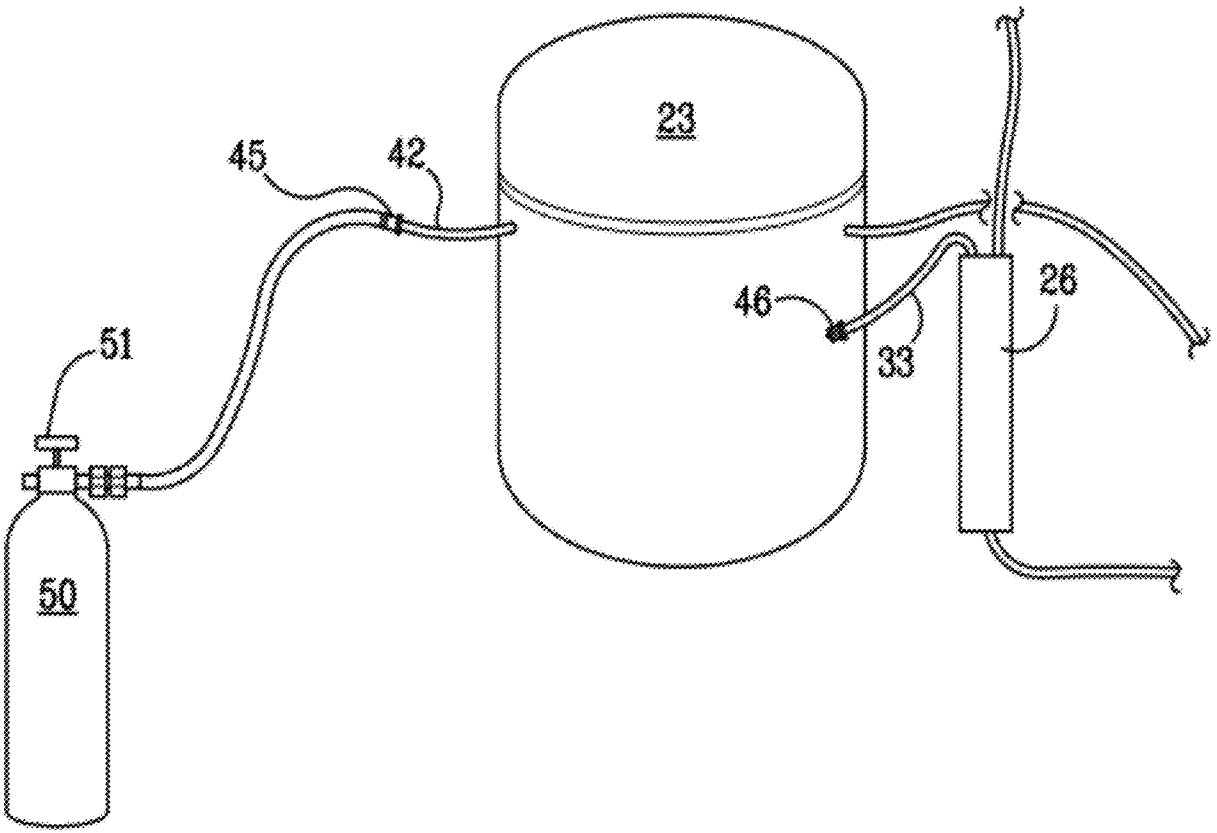

To charge a replacement refrigerant into the refrigeration system 21, the technician connects the hose of a charging container 50 to the low-side access valve 45 (FIG. 7). Preferably, the charging container 50 is pre-measured. The technician then opens the control valve 51 on the charging container 50 to allow the replacement refrigerant to charge the refrigeration system 21 from the low-side section 31. To facilitate or speed up the replacement refrigerant charging step, the compressor 23 can be run for about 3-5 minutes, and preferably the charging container 50 is kept in an upright position in step 309. In addition, warming up the charging container 50, such as by placing it in hot water, will also facilitate or speed up the release of the replacement refrigerant from the charging container 50. The charging container 50 may frost during the injecting step 309. Thus, a room temperature charging container 50 likely indicates it is empty. The charging container 50 is also likely empty when there is no sound of the replacement refrigerant release. After step 309, the technician disconnects the hose and removes the charging container 50 from the refrigeration system 21.

Figure 8:
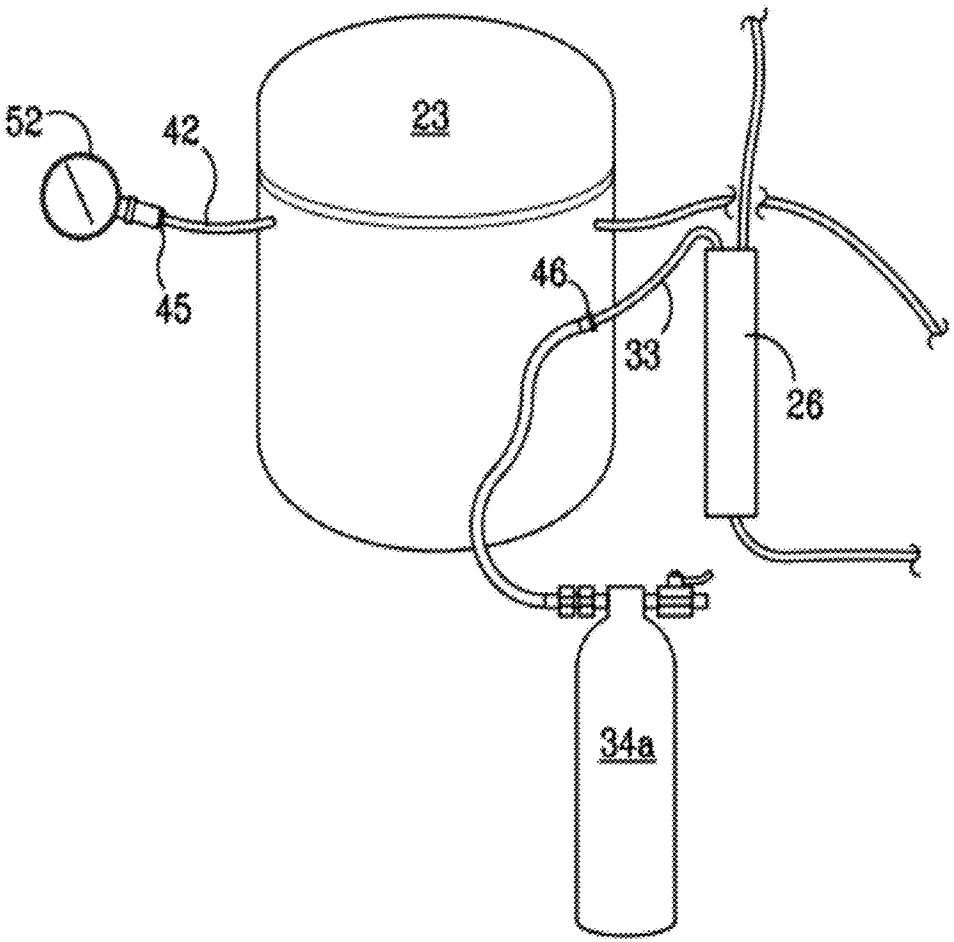

A sweep charge is preferred but not required. This requires the discharge of the replacement refrigerant from the refrigeration system 21. In this regard, the technician connects a pressure gauge 52 to the low-side access valve 45, and connects the same recovery container 34 or another recovery container 34*a* to the high-side access valve 46 (FIG. 8). Once the compressor 23 is run, the replacement refrigerant will be discharged from the refrigeration system 21 from the high-side section 30 through the high-side access valve 46 and flow into the recovery container 34 or 34*a* where it is recovered. The technician terminates this discharging step 310 when he/she notices from a reading of the pressure gauge 52 that a proper vacuum or pressure (for example, when the pressure reaches about the atmospheric pressure) is reached inside the low-side section 31.

After the recovering step 311, the refrigeration system 21 is charged with replacement refrigerant again (step 312). In step 312, the compressor will be run for, for example, about 3-5 minutes. Of course, another pre-measured charging container 50 can be used in step 312.

The used recovery containers 34, 34*a* can be sent to a site where the refrigerant may be either regenerated for later use or disposed of. For regenerating purposes, each used recovery container 34, 34*a* can be heated to a predetermined temperature, such as, for example, 500° F. so that the hydrocarbon refrigerant is released from the adsorptive substance.

Components, such as the piercing valves 32, 40, the process tubes 33, 42, the access valves 45, 46, the control valves 43, 51, and the pressure gauges 44, 52, are known in the art, and therefore are not discussed in detail here.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, not all the steps are compulsory. For example, if a refrigerator is simply to be replaced, then only the releasing step 301 and collecting step 302 are performed to recover the refrigerant. No other steps are required. In addition, not all of the steps or sub-steps need to be performed in the order in which they appear or described. Moreover, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for servicing a refrigeration system containing a refrigerant and comprising a compressor, a high-side section and a low-side section, the method comprising the steps of:

releasing the refrigerant from the refrigeration system from the high-side section;

collecting the released refrigerant with a recovery container containing a refrigerant adsorptive substance;

charging the refrigeration system with inert gas as a sweeping agent from the low-side section; and discharging the inert gas from the refrigeration system from the high-side section.

2. The method of claim 1, wherein the compressor is running in the releasing step.

3. The method of claim 1, wherein the compressor is not running in the charging step.

4. The method of claim 3, wherein the charging step is terminated when pressure in the low-side section reaches a first predetermined threshold.

5. The method of claim 4, wherein the first predetermined threshold is approximately 50 psig.

6. The method of claim 1, further comprising the steps of:

servicing the refrigeration system;

after the servicing step, charging inert gas into the refrigeration system from the low-side section (second charging step);

checking the refrigeration system for leakage; and discharging the inert gas from the refrigeration system from the high-side section (second discharging step).

7. The method of claim 6, wherein the compressor is not running in the second charging step.

8. The method of claim 6, wherein the compressor is running in the second discharging step.

9. The method of claim 8, wherein the compressor is running for at least one minute in the second discharging step.

10. The method of claim 6, wherein the second charging step is terminated when pressure in the low-side section reaches a second predetermined threshold.

11. The method of claim 10, wherein the second predetermined threshold is approximately 50 psig.

12. The method of claim 6, further comprising the step of charging a replacement refrigerant into the refrigeration system from the low-side section.

13. The method of claim 12, wherein the compressor is running in the step of charging the replacement refrigerant.

14. The method of claim 12, wherein the compressor is running for approximately 3-5 minutes in the step of charging the replacement refrigerant.

15. The method of claim 12, further comprising the steps of:

discharging the replacement refrigerant from the refrigeration system from the high-side section; and recovering the discharged replacement refrigerant.

16. The method of claim 15, wherein the compressor is running in the step of discharging the replacement refrigerant.

17. The method of claim 15, wherein the step of charging the replacement refrigerant is repeated after the steps of discharging and recovering the replacement refrigerant.

18. The method of claim 17, wherein the compressor is running when the step of charging the replacement refrigerant is repeated.

19. The method of claim 1, wherein the refrigerant comprises R-600a.

20. The method of claim 12, wherein the refrigerant and the replacement refrigerant are of the same type.

21. The method of claim 20, wherein each of the refrigerant and the replacement refrigerant comprises R-600a.

22. The method of claim 15, wherein the discharged replacement refrigerant is recovered by using the recovery container.

23. The method of claim 15, wherein the discharged replacement refrigerant is recovered by using another recovery container containing a replacement refrigerant adsorptive substance.

* * * * *